US009251724B2

(12) United States Patent
Hottmann et al.

(10) Patent No.: US 9,251,724 B2
(45) Date of Patent: Feb. 2, 2016

(54) BEVERAGE IDENTIFICATION TILES

(71) Applicant: Sub-Zero, Inc., Madison, WI (US)

(72) Inventors: Philip F. Hottmann, Verona, WI (US); Curtis Leroy Cruver, IV, Elmhurst, IL (US); John F. Andrews, Fort Atkinson, WI (US)

(73) Assignee: SUB-ZERO, INC., Madison, WI (US)

( * ) Notice: Subject to any disclaimer, the term of this patent is extended or adjusted under 35 U.S.C. 154(b) by 93 days.

(21) Appl. No.: 14/054,975

(22) Filed: Oct. 16, 2013

(65) Prior Publication Data

US 2015/0102710 A1 Apr. 16, 2015

(51) Int. Cl.

| | |
|---|---|
| ***G09F 3/00*** | (2006.01) |
| ***A47F 5/00*** | (2006.01) |
| ***A47F 3/04*** | (2006.01) |
| ***A47F 7/28*** | (2006.01) |

(52) U.S. Cl.

CPC ..... *G09F 3/00* (2013.01); *A47F 5/0043* (2013.01); *A47F 3/0404* (2013.01); *A47F 7/28* (2013.01)

(58) Field of Classification Search

CPC ..... A47F 3/06; A47F 3/063; A47F 3/04; A47F 3/0404; A47F 2003/04; A47F 2003/06; A47F 3/14; A47F 3/147; A47F 5/0869; A47F 5/0807; A47F 5/0884; A47F 5/0018; A47F 5/0043; A47F 2005/0075; A47F 5/16; A47F 1/00; A47F 1/04; A47F 1/06; A47F 2001/00; A47F 2001/04; A47F 7/28; A47F 7/283; A47B 46/00; A47B 55/02; A47B 73/00; A47B 73/002; A47B 73/006; A47B 73/008; A47B 88/0044; A47B 88/0407; A47B 96/02; A47B 96/021

See application file for complete search history.

(56) References Cited

U.S. PATENT DOCUMENTS

| | | | | | |
|---|---|---|---|---|---|
| 737,888 | A | * | 9/1903 | Webber | 40/649 |
| 854,971 | A | | 5/1907 | Thomas | |
| 1,564,595 | A | * | 12/1925 | Lohrer | 40/5 |
| 1,629,070 | A | | 5/1927 | Cox | |
| 2,771,854 | A | | 11/1956 | Cronenwett | |
| 2,898,171 | A | * | 8/1959 | Ehlert et al. | 312/122 |
| 2,990,196 | A | * | 6/1961 | Slavsky | 40/5 |
| 3,180,310 | A | * | 4/1965 | Giebel | 116/309 |
| 3,650,055 | A | * | 3/1972 | Bult, III | 40/506 |
| 4,176,484 | A | | 12/1979 | Terris | |

(Continued)

FOREIGN PATENT DOCUMENTS

DE 102007051336 A1 * 4/2009 ..... A47B 73/00

OTHER PUBLICATIONS

Notice of Allowance for U.S. Appl. No. 29/469,916, mailed on Nov. 13, 2014, 11 pp.

*Primary Examiner* — Andrew Roersma
(74) *Attorney, Agent, or Firm* — Bell & Manning LLC

(57) ABSTRACT

A beverage identification tile is provided that includes a sheet of material and a plurality of beverage type identifiers. The sheet of material has a first face and a second face which have a polygonal shape defined by a plurality of edges. A different beverage type identifier of the plurality of beverage type identifiers is printed along each edge of the plurality of edges of the first face and of the second face. A shelf labeling system includes a shelf, a plurality of slots, and the beverage identification tile. The shelf includes a front wall, a back wall, and a base mounted between the front wall and the back wall. The sheet of material is sized to slide into a slot of the plurality of slots formed in the front wall along an edge of the front wall with a beverage type identifier visible above the edge.

12 Claims, 12 Drawing Sheets

(56) References Cited

U.S. PATENT DOCUMENTS

| | | | | |
|---|---|---|---|---|
| D281,213 | S | 11/1985 | James et al. | |
| D391,995 | S | 3/1998 | Hackmeister | |
| D393,001 | S | 3/1998 | Mayo | |
| 5,992,073 | A | 11/1999 | Wolpa | |
| D422,641 | S | 4/2000 | Harris, Sr. | |
| 6,361,129 | B1 * | 3/2002 | Borgen | 312/128 |
| D476,699 | S | 7/2003 | Flinn | |
| 6,584,716 | B2 * | 7/2003 | Paul | 40/618 |
| D508,535 | S | 8/2005 | Kosek | |
| 6,981,597 | B2 * | 1/2006 | Cash | 211/74 |
| D515,629 | S | 2/2006 | Nudo, Jr. | |
| D516,275 | S | 3/2006 | Anaya | |
| 7,063,219 | B2 * | 6/2006 | Fann et al. | 211/74 |
| 7,205,508 | B2 * | 4/2007 | Sakanoue et al. | 219/403 |
| D542,860 | S | 5/2007 | David | |
| 7,234,254 | B2 * | 6/2007 | Schmidt | 40/310 |
| D571,608 | S | 6/2008 | Yeung | |
| D581,726 | S | 12/2008 | Shamoon | |
| 7,513,074 | B2 * | 4/2009 | Glenn et al. | 40/649 |
| 7,591,093 | B2 | 9/2009 | Saylor | |
| D601,635 | S | 10/2009 | Spengler | |
| 7,617,623 | B1 | 11/2009 | Goldberg | |
| 7,690,519 | B2 * | 4/2010 | Kahl et al. | 211/59.2 |
| D640,089 | S | 6/2011 | Green et al. | |
| D640,327 | S | 6/2011 | Gorzo | |
| D642,623 | S | 8/2011 | Turner et al. | |
| D678,951 | S | 3/2013 | Kaderli | |
| D684,625 | S | 6/2013 | André | |
| D703,092 | S | 4/2014 | Mansoor | |
| D703,741 | S | 4/2014 | Ehrlich et al. | |
| D709,128 | S | 7/2014 | Reed et al. | |
| D710,440 | S | 8/2014 | Reed et al. | |
| 2003/0024141 | A1 | 2/2003 | Sawchuk | |
| 2004/0111941 | A1 | 6/2004 | Spear et al. | |
| 2005/0223610 | A1 | 10/2005 | Vogler | |
| 2009/0178427 | A1 * | 7/2009 | Eichman | 62/331 |
| 2012/0266509 | A1 * | 10/2012 | Garfinkle | 40/606.19 |

* cited by examiner

BEVERAGE IDENTIFICATION TILES

BACKGROUND

Alcoholic beverage storage devices such as wine closets are typically designed to store wine with the bottles on their sides at an approximately horizontal angle to prevent drying of the cork or stopper. As a result, either the cork end or the bottom end of the bottle is positioned along the outside face of the wine closet that is readily visible by a consumer. To determine which type of beverage a bottle holds, the consumer typically withdraws the shelf that holds the bottle and/or lifts the bottle up to read the label. In many cases, the wine closet is refrigerated. Therefore, opening the wine closet to read the bottle label is necessary, which causes a loss of refrigerated air wasting electricity as well as the time and energy of the consumer.

SUMMARY

In an example embodiment, a beverage identification tile is provided. The beverage identification tile includes, but is not limited to, a sheet of material and a plurality of beverage type identifiers. The sheet of material has a first face and a second face that is opposite the first face. The first face and the second face have a polygonal shape defined by a plurality of edges. A different beverage type identifier of the plurality of beverage type identifiers is printed along each edge of the plurality of edges of the first face and along each edge of the plurality of edges of the second face.

In another example embodiment, a shelf labeling system is provided. The shelf labeling system includes, but is not limited to, a shelf, a plurality of slots, and the beverage identification tile. The shelf includes, but is not limited to, a base, a front wall, and a back wall. The base is mounted between the front wall and the back wall. The plurality of slots are formed in the front wall along an edge of the front wall. The sheet of material is sized to slide into a slot of the plurality of slots with a beverage type identifier visible above the edge of the front wall.

In yet another example embodiment, a device is provided. The device includes, but is not limited to, a plurality of walls that define a receptacle, a door, a hinge pivotally mounting the door to a wall of the plurality of walls, and the shelf labeling system. The shelf is mounted between a pair of walls of the plurality of walls such that the front wall is positioned to face the door.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
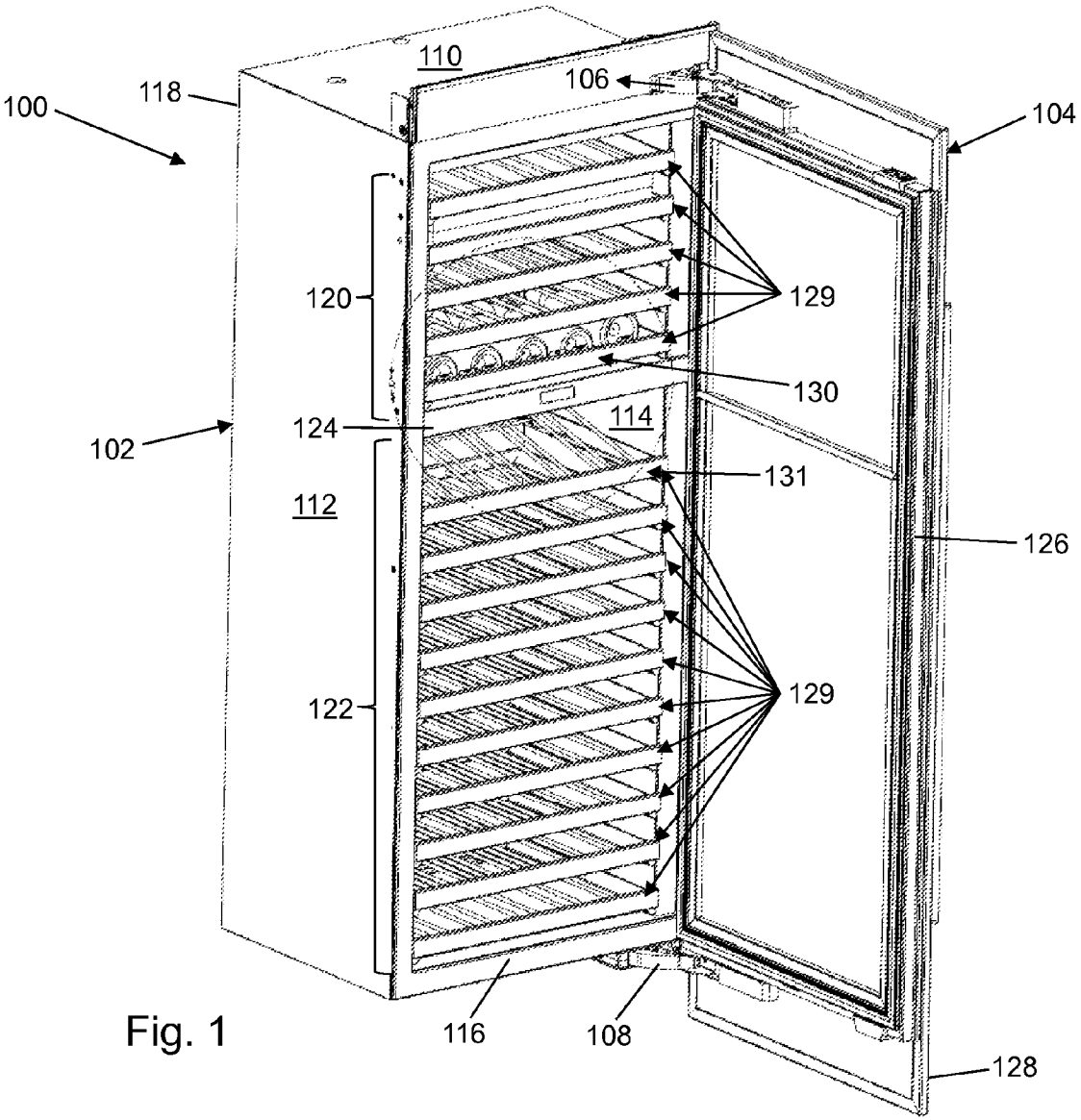
FIG. 1 depicts a left side, perspective view of a wine closet with open compartment doors in accordance with an illustrative embodiment.

With reference to FIG. 1, a beverage holder 100 is shown in accordance with an illustrative embodiment. Beverage holder 100 may include a body 102, a door 104, a first hinge 106, and a second hinge 108. In the illustrative embodiment, door 104 is rotatably mounted to body 102 using first hinge 106 and second hinge 108. In alternative embodiments, door 104 may be rotably mounted to different walls of beverage holder 100 using a fewer or a greater number of hinges. Merely for illustration, beverage holder 100 may be a refrigerator, a wine closet, a beer storage closet, a mini-refrigerator, etc.

As used in this disclosure, the term "mount" includes join, unite, connect, couple, associate, insert, hang, hold, affix, attach, fasten, bind, paste, secure, bolt, screw, rivet, pin, nail, clasp, clamp, cement, fuse, solder, weld, glue, form over, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements.

In the illustrative embodiment, body 102 may include a top wall 110, a first side wall 112, a second side wall 114, a bottom wall 116, and a back wall 118. Use of directional terms, such as top, bottom, right, left, front, back, etc. are merely intended to facilitate reference to the various surfaces of the described structures relative to the orientations shown in the drawings and are not intended to be limiting in any manner. Top wall 110, first side wall 112, second side wall 114, bottom wall 116, back wall 118, and door 104 form an enclosed space or receptacle when door 104 is positioned in a closed position. With reference to FIG. 1, door 104 is shown in an open position to allow access to the receptacle by a consumer.

Beverage holder 100 may include components of a heat exchange system (not shown) as understood by a person of skill in the art. The heat exchange system may be configured to cool the receptacle or enclosed space. One or more of the walls that form body 102 may include various other electrical and/or electro-mechanical components, conduits, etc. to support operation of the heat exchange system. In alternative embodiments, beverage holder 100 may not include a heat exchange system instead maintaining the receptacle at a temperature of a surrounding environment.

Though shown in the illustrative embodiment as forming a generally rectangular shaped enclosure, beverage holder 100 may form any shaped enclosure. As a result, door 104 and the walls of body 102 may have any shape including other polygons as well as circular or elliptical shapes.

In the illustrative embodiment, the body 102 further includes a first compartment 120 and a second compartment 122. First compartment 120 and second compartment 122 are separate by a divider wall 124 that may be insulated. In the illustrative embodiment, divider wall 124 extends horizontally between first side wall 112 and second side wall 114. Divider wall 124 defines two separate compartments so that first compartment 120 and second compartment 122 can be maintained at different temperatures. First compartment 120 is defined by top wall 110, a top portion of first side wall 112, a top portion of second side wall 114, a top portion of back wall 118, divider wall 124, and door 104 when door 104 is in a closed position. Second compartment 122 is defined by divider wall 124, a bottom portion of first side wall 112, a bottom portion of second side wall 114, a bottom portion of back wall 118, bottom wall 116, and door 104 when door 104 is in a closed position. In general, first compartment 120 and second compartment 122 are maintained at a temperature selected by the consumer for maintaining the beverages stored in the respective compartment at an appropriate temperature based on the one or more types of beverages stored therein.

In alternative embodiments, beverage holder 100 may include additional or fewer divider walls to arrange the receptacle into one or more compartments that can be maintained at different temperatures. In the illustrative embodiment, first compartment 120 is positioned above second compartment 122 though, of course, first compartment 120 and second compartment 122 can be positioned in a side-by-side type configuration. In a side-by-side type configuration, divider wall 124 extends vertically.

Door 104 may be formed of a glass panel so that a consumer can view the beverages stored therein without opening door 104 and releasing refrigerated air into the surrounding environment. Door 104 may include a structural door panel 126 and a decorative door panel 128. Decorative door panel 128 mounts to structural door panel 126 and provides a more aesthetically pleasing exterior for beverage holder 100.

A plurality of shelves 129 may be mounted within body 102 such as within each of first compartment 120 and second compartment 122. The plurality of shelves 129 may be mounted to one or more of first side wall 112, second side wall 114 and back wall 118 using a variety of mounting methods as understood to a person of skill in the art. The plurality of shelves 129 includes a first shelf 130 and a second shelf 131. One or more of the plurality of shelves 129 further may be structured as drawers or other types of receptacles mounted within body 102. The plurality of shelves 129 may be angularly adjustable and/or height adjustable. For example, second shelf 131 has been adjusted such that second shelf 131 extends upward towards back wall 118 relative to a horizontal plane defined between door 104 and back wall 118. Additionally, one or more shelves may be integrated as part of bottom wall 116 or divider wall 124.

As understood by a person of skill in the art, the walls that form beverage holder 100 may include insulation to assist in maintenance of the desired temperature in first compartment 120 and second compartment 122. The plurality of shelves 129 may be formed of one or more materials, such as metals, glass, and/or plastics having a sufficient strength and rigidity to support beverages, food items, etc. stored in beverage holder 100.

Figure 2:
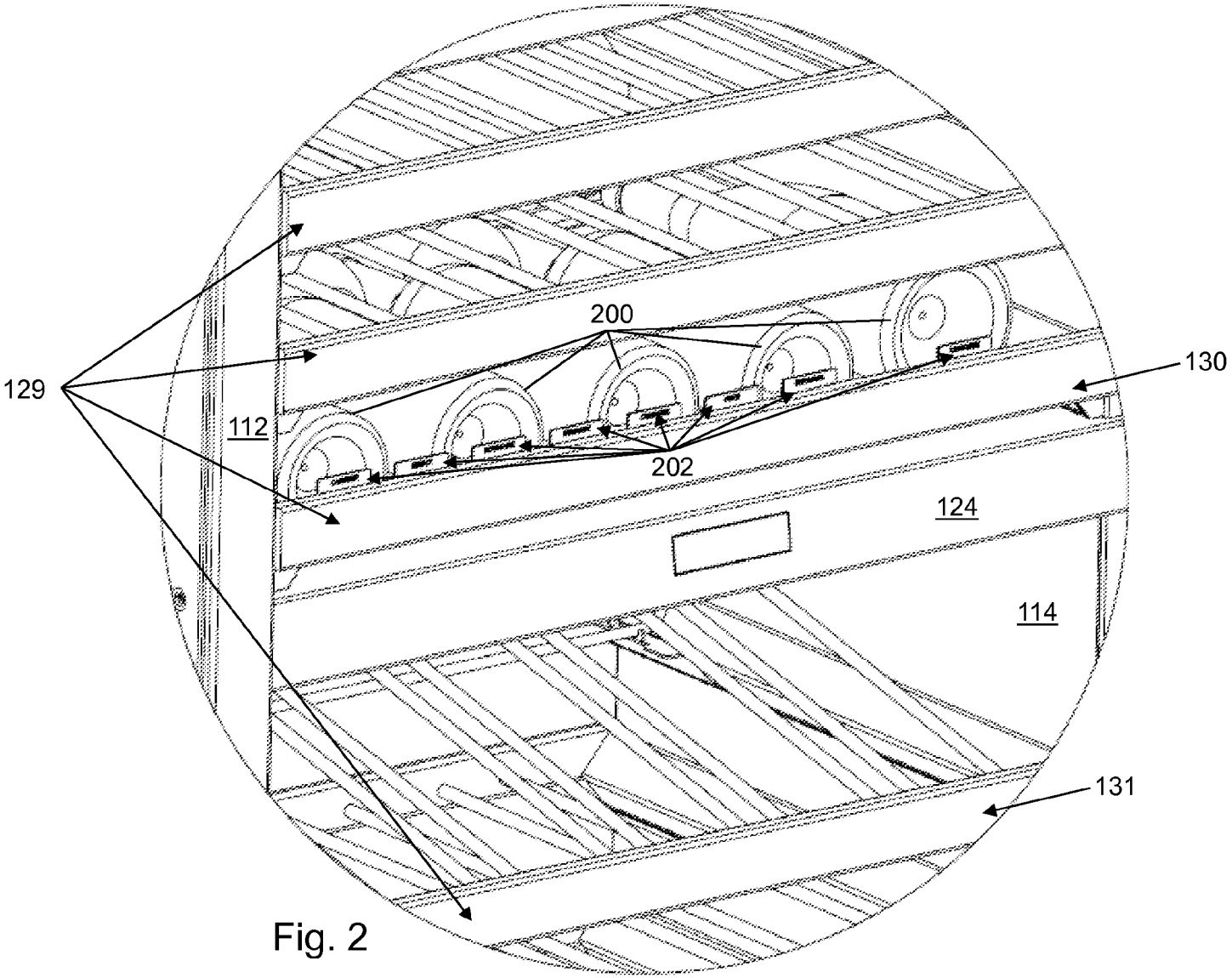
FIG. 2 depicts a zoomed view of a portion of the wine closet of FIG. 1.

With reference to FIG. 2, a zoomed view of first shelf 130 and second shelf 131 is shown in accordance with an illustrative embodiment. A plurality of bottles 200 are horizontally placed on first shelf 130. In the illustrative embodiment, the plurality of bottles 200 are wine bottles including a body and a neck both with circular profiles. The neck has a smaller circumference. In other embodiments, the bottles may hold other beverages and may have different profile shapes such as rectangular, triangular, elliptical, etc.

A plurality of beverage identification tiles 202 (discussed in more detail with reference to FIGS. 12*a*-12*e* and 13*a*-13*c*) is mounted to first shelf 130. The plurality of beverage identification tiles 202 may be mounted to all or a subset of the plurality of shelves 129. A portion of each of the plurality of beverage identification tiles 202 is visible above first shelf 130 by a consumer through door 104 if door 104 includes a see through panel. The portion of each of the plurality of beverage identification tiles 202 further is visible above first shelf 130 by a consumer when door 104 is in the open position.

Figure 3:
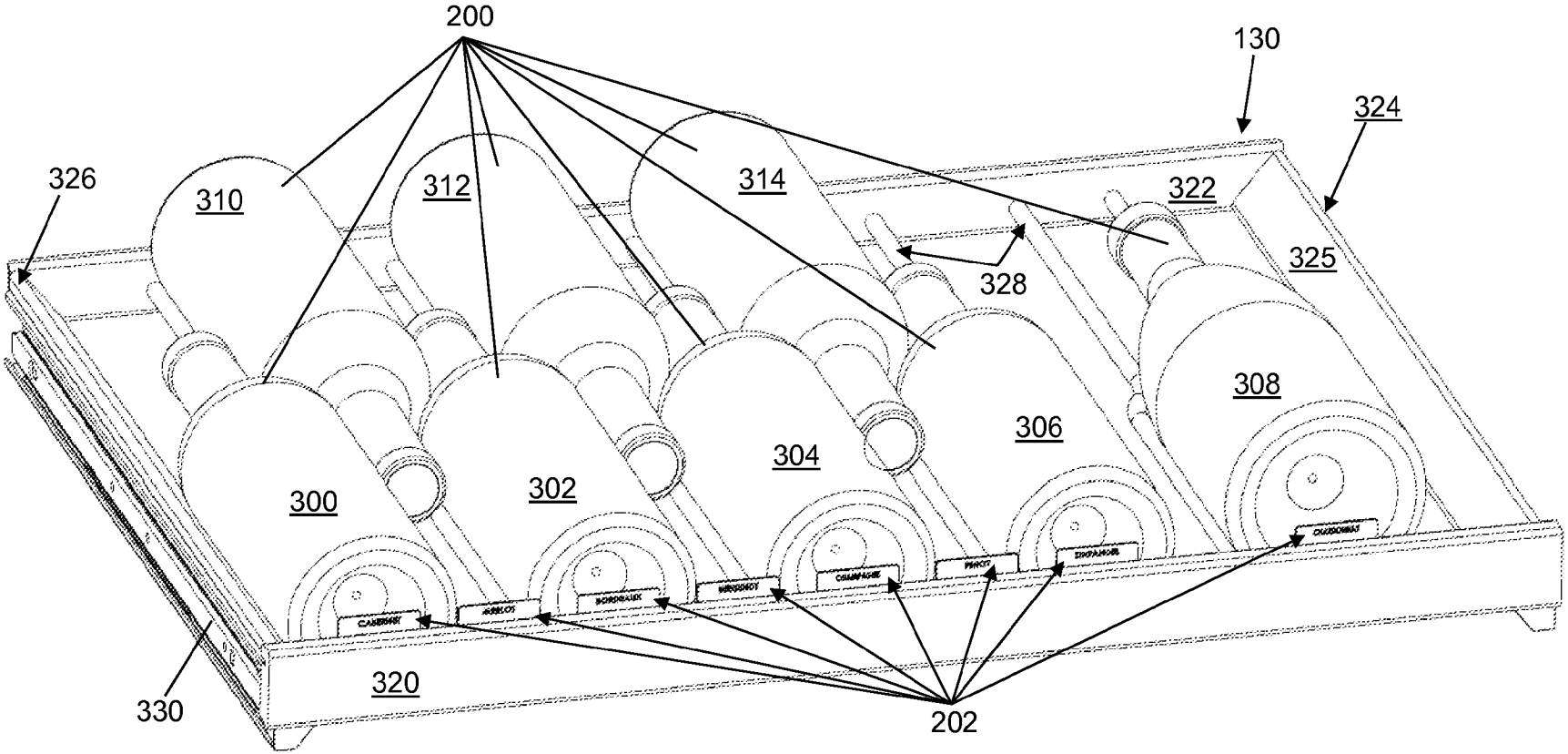
FIG. 3 depicts a top, front perspective view of a shelf of the wine closet of FIG. 1 holding wine bottles in accordance with an illustrative embodiment.

With reference to FIG. 3, first shelf 130 is shown in accordance with an illustrative embodiment. The plurality of bottles 200 include a first bottle 300, a second bottle 302, a third bottle 304, a fourth bottle 306, a fifth bottle 308, a sixth bottle 310, a seventh bottle 312, and an eighth bottle 314. First shelf 130 may be sized to support a fewer or a greater number of bottles of the same or different sizes. For example, fifth bottle 308 is larger than the other illustrated bottles. In the illustrative embodiment, first shelf 130 further is sized to support a ninth bottle in a space between fourth bottle 306 and fifth bottle 308.

First shelf 130 may include a shelf front wall 320, a shelf back wall 322, a right side wall 324, a left side wall 326, and a base 328. Shelf front wall 320 is positioned to face door 104 when first shelf 130 is mounted in body 102. Right side wall 324 is positioned adjacent second side wall 114, left side wall 326 is positioned adjacent first side wall 112, and shelf back wall 322 is positioned adjacent back wall 118 when first shelf 130 is mounted within body 102. As shown with reference to FIG. 10, shelf back wall 322 has a c-shaped profile that may insert into corresponding grooves formed in back wall 118 of body 102.

Right side wall 324 is mounted between a first end of shelf front wall 320 and a first end of shelf back wall 322. Left side wall 326 is mounted between a second end of shelf front wall 320 and a second end of shelf back wall 322. The first ends of shelf front wall 320 and shelf back wall 322 are opposite the second ends of shelf front wall 320 and shelf back wall 322. Base 328 may be mounted to one or more of shelf front wall 320, shelf back wall 322, right side wall 324, and left side wall 326. In the illustrative embodiment, base 328 includes a plurality of rods mounted between shelf front wall 320 and shelf back wall 322 as shown more clearly with reference to FIG. 4. Of course, in alternative embodiments, base 328 may form a solid surface or a partially solid surface that extends between shelf front wall 320 and shelf back wall 322. For example, base 328 may be formed of a solid surface with ribs instead of the plurality of rods as illustrated.

In the illustrative embodiment, a left sliding bracket 330 is mounted to left side wall 326 and a right sliding bracket 406 (shown with reference to FIG. 4) is mounted to right side wall 324. Left sliding bracket 330 and right sliding bracket 406 are configured to mate with corresponding sliding brackets or rails (not shown) mounted on second side wall 114 and first side wall 112, respectively, to allow first shelf 130 to be slid into and out of body 102 as understood by a person of skill in the art.

Figure 4:
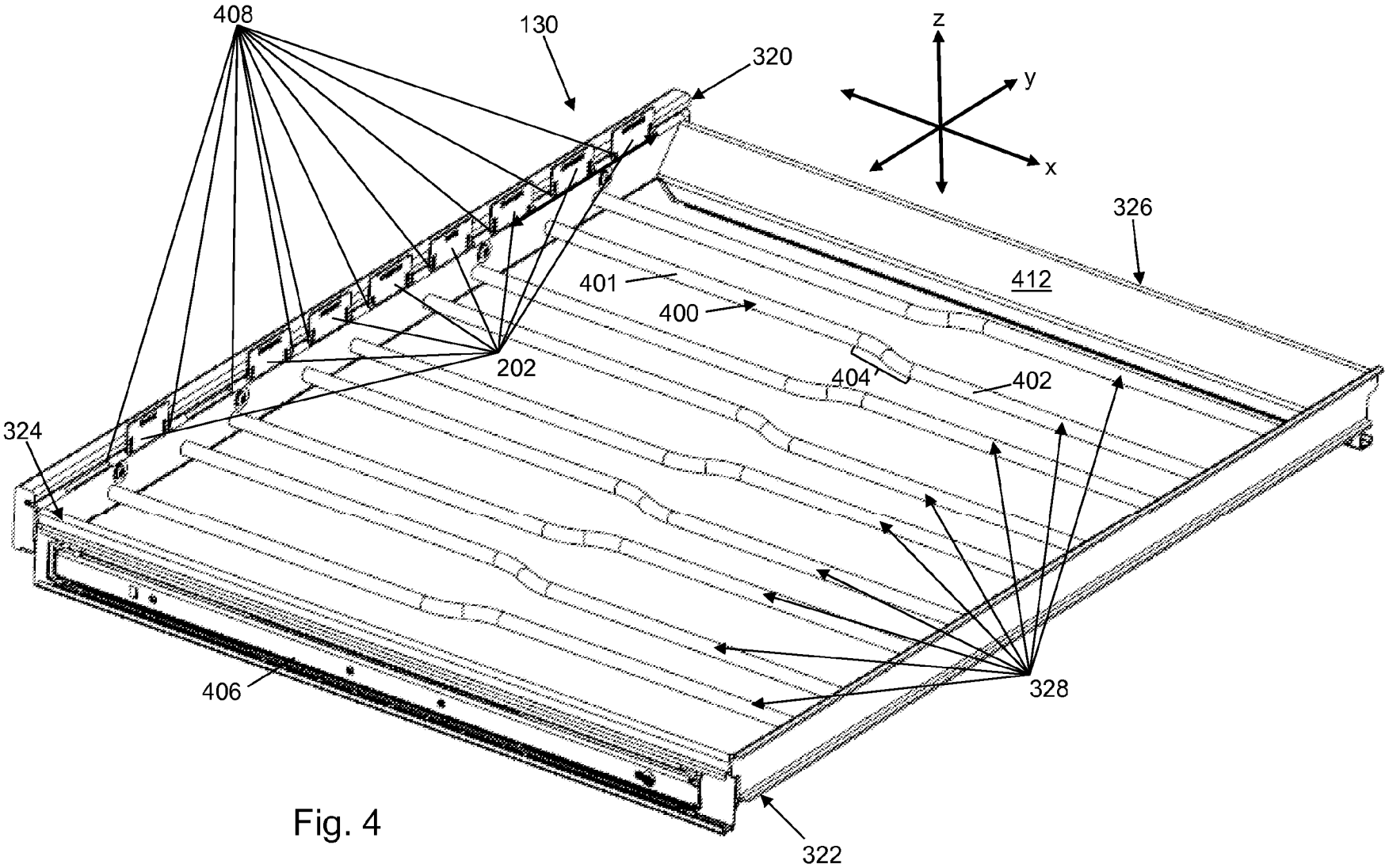
FIG. 4 depicts a top, back perspective view of the shelf of FIG. 3 without wine bottles in accordance with an illustrative embodiment.

With reference to FIG. 4, a back perspective view of first shelf 130 is shown without any bottles mounted thereon. For reference, a xyz coordinate system is shown. In the illustrative embodiment, shelf front wall 320 and shelf back wall 322 extend primarily parallel to the yz plane though each wall also has components that extend in the x direction. In the illustrative embodiment, right side wall 324 and left side wall 326 extend primarily parallel to the xz plane though each wall also has components that extend in the y direction. In the illustrative embodiment, shelf front wall 320, shelf back wall 322, right side wall 324, and left side wall 326 are generally rectangular though the walls 320, 322, 324, 326 may have other shapes.

A first rod 400 of the plurality of rods that form base 328 may include a first a first rod portion 401, a second rod portion 402, and a third rod portion 404. A first end of first rod portion 401 mounts to and extends from shelf front wall 320 generally parallel to right side wall 324 and left side wall 326. Thus, first rod portion 401 extends in the x direction. A first end of second rod portion 402 mounts to and extends from shelf front wall 320 generally parallel to right side wall 324 and left side wall 326. Thus, second rod portion 402 also extends in the x direction. In the illustrative embodiment, the first end of first rod portion 401 mounts to shelf front wall 320 at a first distance from left side wall 326, and the first end of second rod portion 402 mounts to shelf back wall 322 at a second distance from left side wall 326. The first distance is different from the second distance. Third rod portion 404 mounts between a second end of first rod portion 401 and a second end of second rod portion 402. In the illustrative embodiment, third rod portion 404 forms a curved section though, of course, third rod portion 404 may be formed of a straight section.

Successive rods of the plurality of rods of base 328 are mirror images of each other relative to the xz plane that extends between shelf front wall 320 and shelf back wall 322. Due to the mirror image and the varying distances from the side walls 324, 326, the plurality of rods form alternating wider and narrower sections in the y direction. The spacing between the plurality of rods of base 328 is selected based on the size of the bottles to be stored on first shelf 130. The spacing between the narrower sections may be selected based on a neck dimension of the bottles, and the spacing between the wider sections may be selected based on a body dimension of the bottles. The spacing further facilitates the storage of bottles in alternating +x and −x directions as shown with reference to FIG. 3. The bottoms of first bottle 300, second bottle 302, third bottle 304, fourth bottle 306, and fifth bottle 308 are positioned adjacent shelf front wall 320, and the bottoms of sixth bottle 310, seventh bottle 312, and eighth bottle 314 are positioned adjacent shelf back wall 322. Because right side wall 324 and left side wall 326 are longer than twice the length of the body of an individual bottle of the plurality of bottles, a greater number of bottles can be stored on first shelf 130. Of course, in alternative embodiments, first shelf 130 may not be configured to support bottles aligned in this manner.

With reference to FIG. 4, the plurality of beverage identification tiles 202 are mounted within a plurality of slots 408. The plurality of slots 408 are formed in shelf front wall 320 at positions selected based on the expected location of bottles to be stored on first shelf 130. For example, in the illustrative embodiment, first shelf 130 is designed to hold up to ten typically sized wine bottles. As a result, the plurality of slots 408 consist of ten slots distributed in the y direction along a top surface of shelf front wall 320. In alternative embodiments, there may be a greater or a fewer number of slots of the plurality of slots 408. In the illustrative embodiment, a slot is positioned between each successive pair of rods of the plurality of rods of base 328. In the illustrative embodiment, a first wall surface 325 of right side wall 324 is tilted downwards towards an interior of first shelf 130, and a first wall surface 412 of left side wall 326 is tilted downwards towards the interior of first shelf 130. As a result, first wall surface 325 of right side wall 324 and first wall surface 412 of left side wall 326 may be used to support a bottle. In the illustrative embodiment, a slot is positioned between right side wall 324 and a first rod closest to right side wall 324, and between left side wall 326 and a first rod closest to left side wall 326.

Figure 5:
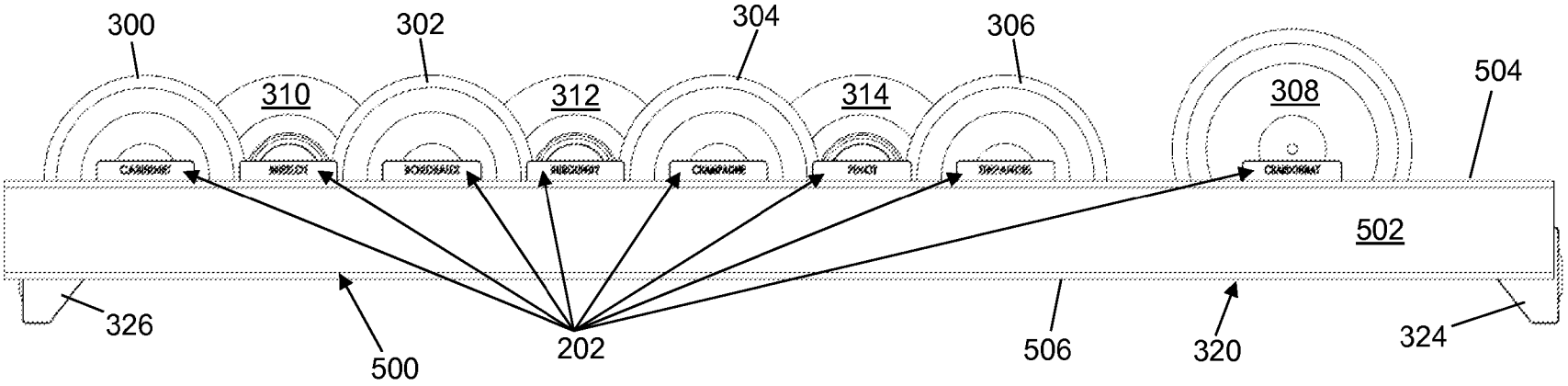
FIG. 5 depicts a front side view of the shelf of FIG. 3 holding wine bottles in accordance with an illustrative embodiment.
Figure 6:
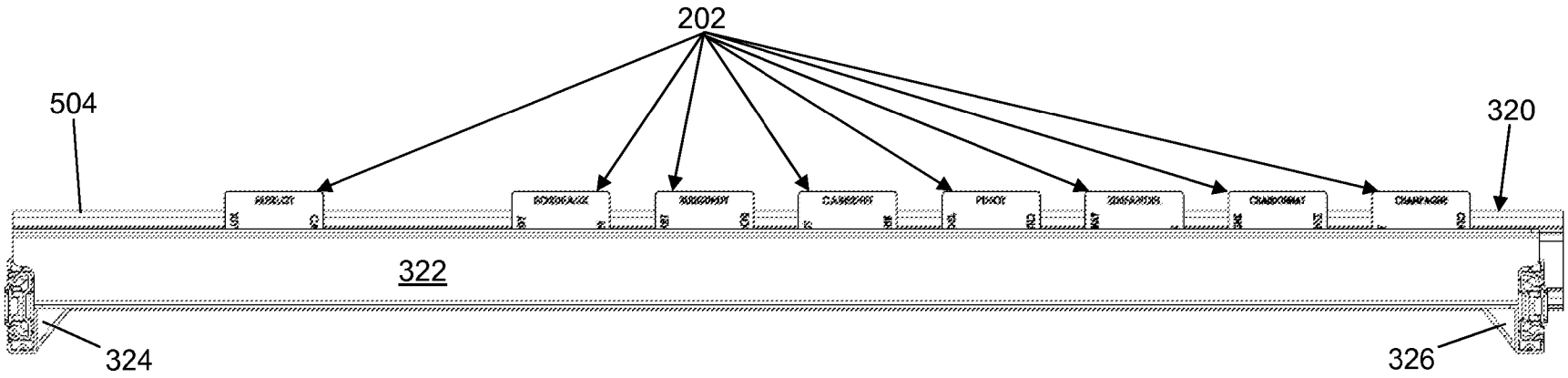
FIG. 6 depicts a back side view of the shelf of FIG. 3 without wine bottles in accordance with an illustrative embodiment.
Figure 7:
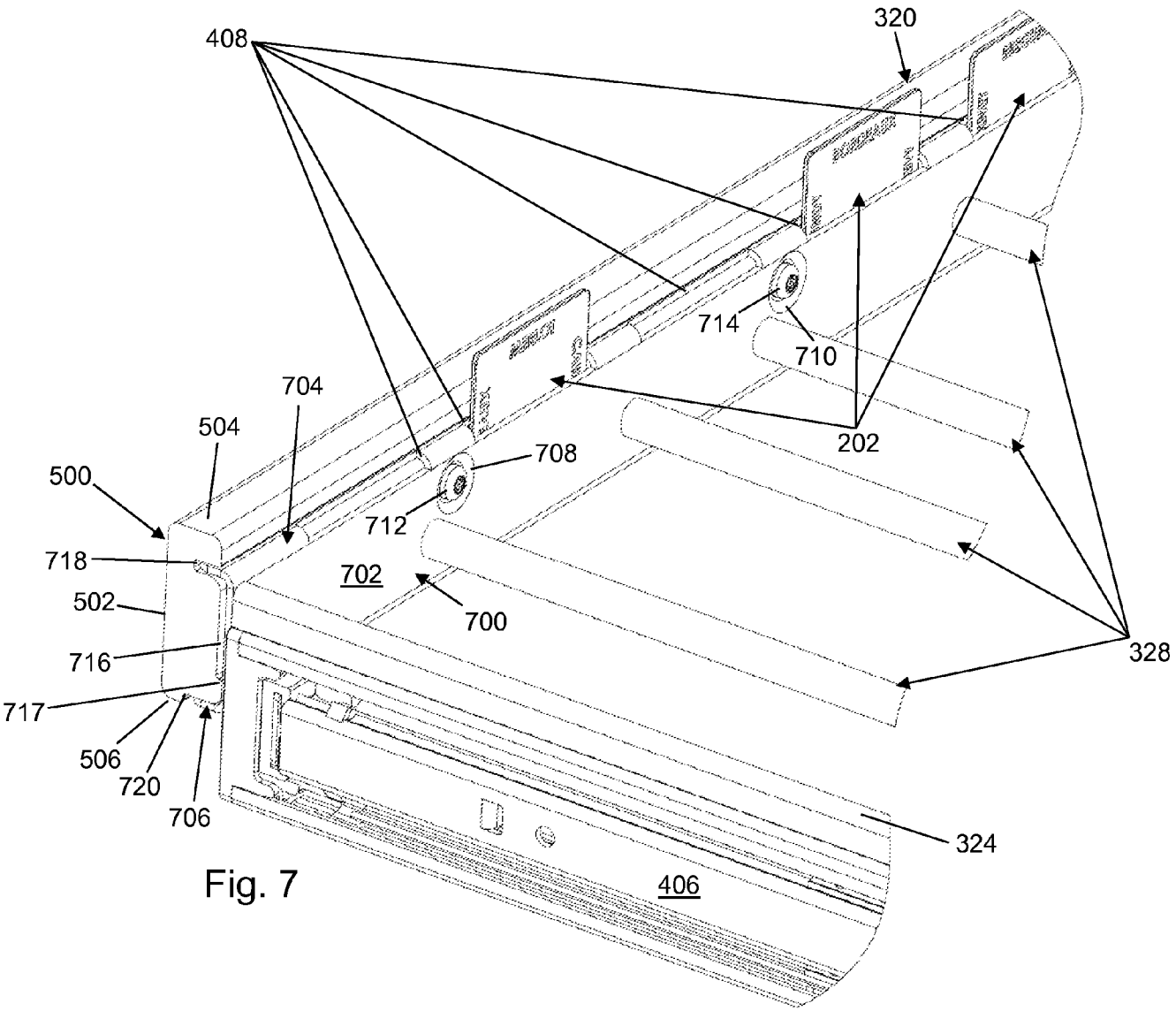
FIG. 7 depicts a zoomed top, back perspective view of the shelf of FIG. 3 without wine bottles in accordance with an illustrative embodiment.
Figure 8:
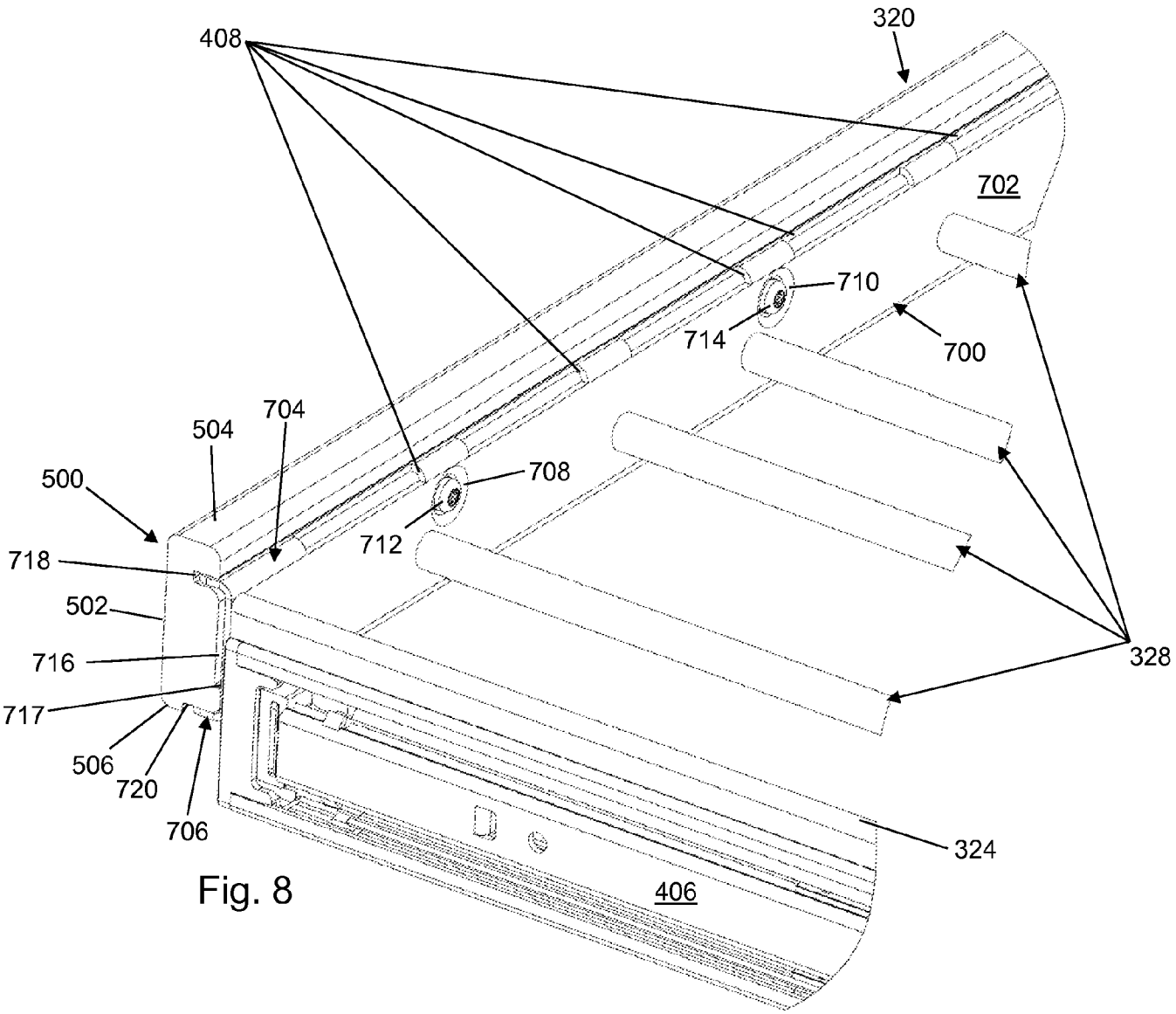
FIG. 8 depicts a zoomed top, back perspective view of the shelf of FIG. 3 without wine bottles or beverage identification tiles in accordance with an illustrative embodiment.
Figure 9:
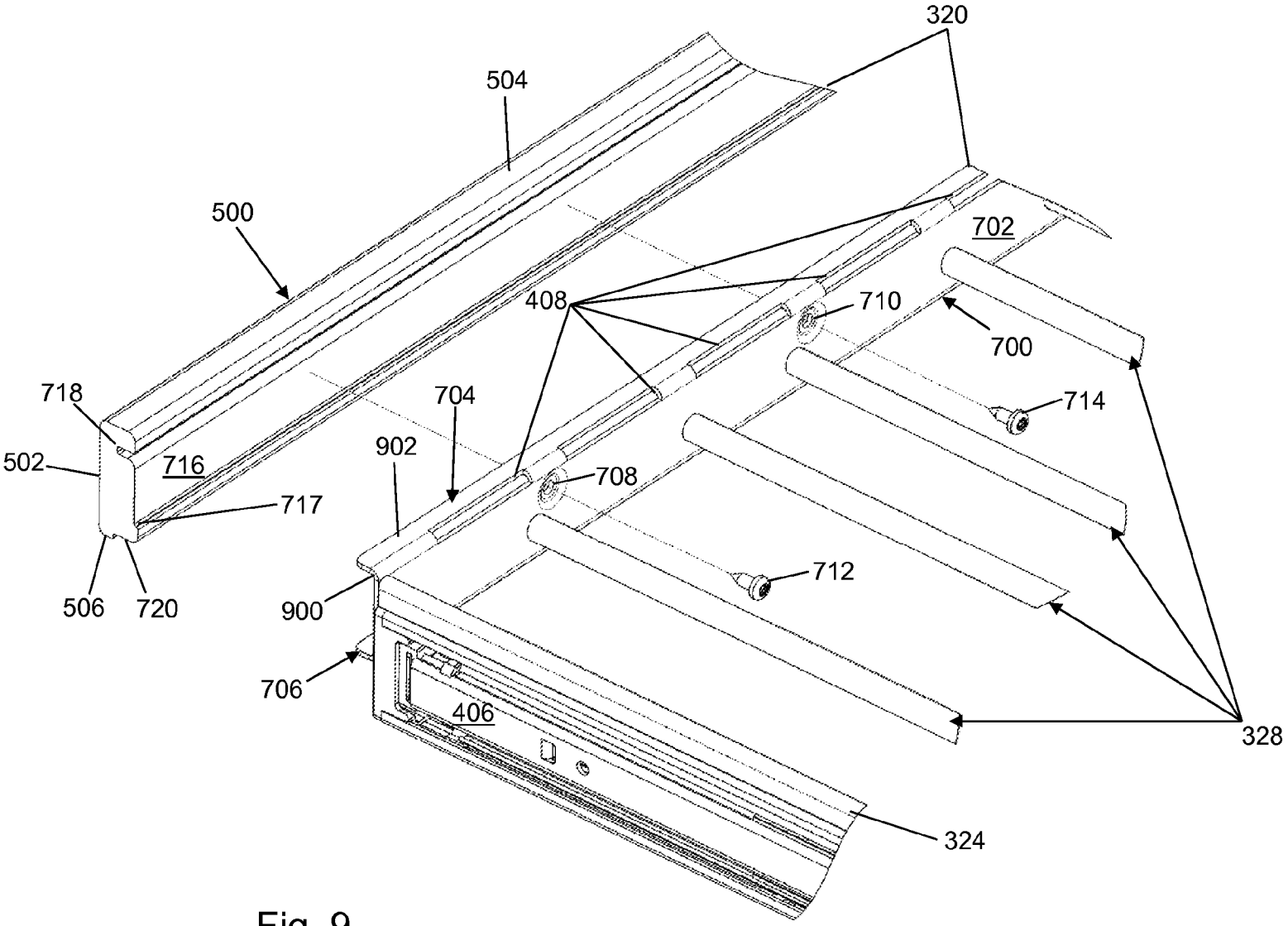
FIG. 9 depicts a zoomed exploded view of the shelf of FIG. 3 without wine bottles or beverage identification tiles in accordance with an illustrative embodiment.

With reference to FIG. 5, a front view of first shelf 130 is shown in accordance with an illustrative embodiment. With reference to FIG. 6, a back view of first shelf 130 is shown in accordance with an illustrative embodiment. With reference to FIG. 7, a back perspective view of first shelf 130 is shown zoomed to show a right front corner of first shelf 130 including a subset of the plurality of beverage identification tiles 202 in accordance with an illustrative embodiment. With reference to FIG. 8, the back perspective view of FIG. 7 is shown without the plurality of beverage identification tiles 202. With reference to FIG. 9, a partially exploded back perspective view of first shelf 130 is shown without the plurality of beverage identification tiles 202. Shelf front wall 320 may be formed of a single piece of material, for example, by molding, or may be formed of multiple distinct pieces mounted together. For example, the plurality of slots 408 may be formed in a top edge of an otherwise solid component to which base 328, right side wall 324, and/or left side wall 326 are mounted.

In the illustrative embodiment of FIGS. 5-9, shelf front wall 320 may include a first wall portion 500 mounted to a second wall portion 700. First wall portion 500 includes a front surface 502, a top surface 504, a bottom surface 506, and a back surface 716. Front surface 502, top surface 504, bottom surface 506, and back surface 716 are generally flat. Top surface 504 extends generally perpendicularly between front surface 502 and back surface 716. Bottom surface 506 extends generally perpendicularly between front surface 502 and back surface 716. A protrusion 717 may be formed to extend outward from back surface 716 near bottom surface 506. A valley 718 may be formed in back surface 716 near top surface 504. A notch 720 may be formed in bottom surface 506.

In the illustrative embodiment, second wall portion 700 includes a first plate 702, a second plate 704, and a third plate 706. Second plate 704 includes a curved section 900 (shown with reference to FIG. 9) and a straight section 902 (shown with reference to FIG. 9). Curved section 900 of second plate 704 extends from a first edge of first plate 702. Straight section 902 of second plate 704 extends from curved section 900 generally perpendicularly relative to first plate 702. Third plate 706 includes a curved section 1100 (shown with reference to FIG. 11) and a straight section 1102 (shown with reference to FIG. 11). Curved section 1100 of third plate 706 extends from a second edge of first plate 702. Straight section 1102 of third plate 706 extends from curved section 1100 generally perpendicularly relative to first plate 702. The first edge of first plate 702 is opposite the second edge of first plate 702. Thus, second wall portion 700 has a u-shaped profile when projected into the xz plane.

A first aperture 708 and a second aperture 710 may be formed through first plate 702. Apertures (not shown) further may be formed through back surface 716 of first wall portion 500. First aperture 708 and second aperture 710 are sized and shaped to accept a first fastener 712 and a second fastener 714, respectively. First fastener 712 and second fastener 714 may be inserted in first aperture 708 and second aperture 710 to mount second wall portion 700 to first wall portion 500. Of course, other mounting methods may be used.

Figure 10:
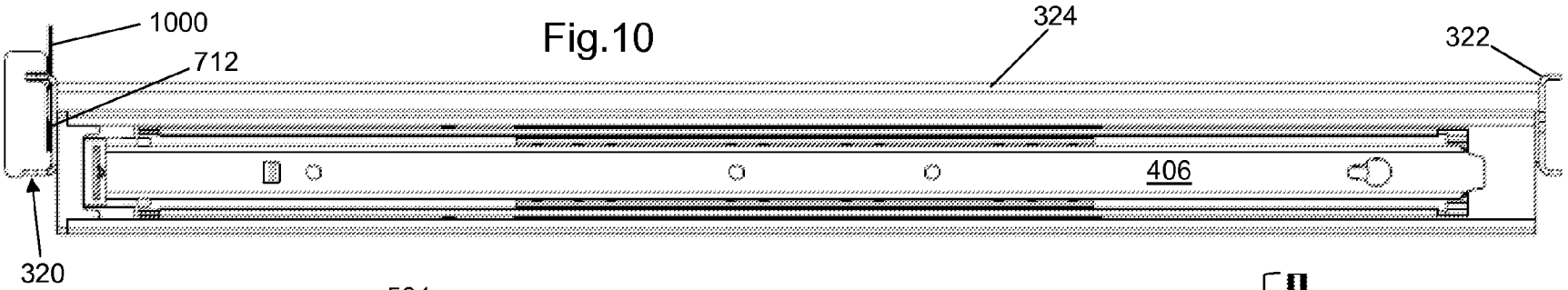
FIG. 10 depicts a right side view of the shelf of FIG. 3 without wine bottles in accordance with an illustrative embodiment.
Figure 11B:
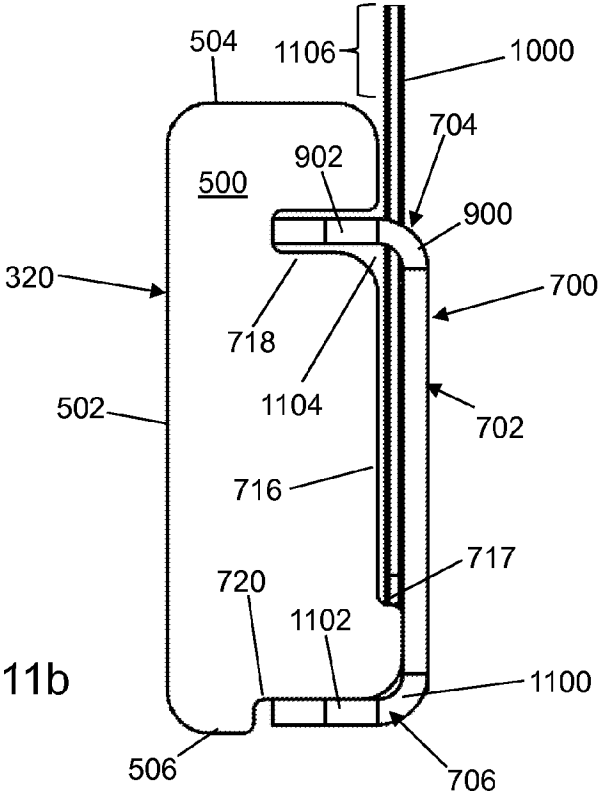
FIG. 11*b* depicts a zoomed right side view of a front wall of the shelf of FIG. 3 with a beverage identification tile in accordance with an illustrative embodiment.
Figure 11A:
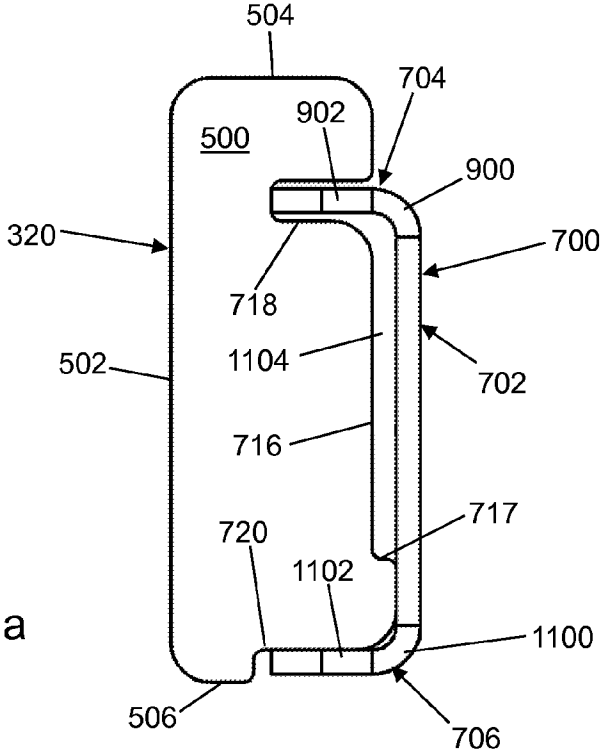
FIG. 11*a* depicts a zoomed right side view of a front wall of the shelf of FIG. 3 without a beverage identification tile in accordance with an illustrative embodiment.

With reference to FIG. 10, a side view of first shelf 130 is shown with a beverage identification tile 1000 in accordance with an illustrative embodiment. With reference to FIG. 11*a*, a side view of shelf front wall 320 without a beverage identification tile is shown in accordance with an illustrative embodiment. With reference to FIG. 11*b*, a side view of shelf front wall 320 with beverage identification tile 1000 is shown in accordance with an illustrative embodiment. When second wall portion 700 is mounted to first wall portion 500, a gap 1104 is formed between first plate 702 and back surface 716 of first wall portion 500. Straight section 902 of second plate 704 fits within valley 718 of first wall portion 500, and straight section 102 of third plate 706 fits within notch 720. Protrusion 717 forms a bottom of gap 1104.

In the illustrative embodiment, the plurality of slots 408 are formed in curved section 900 of second plate 704. In alternative embodiments, the plurality of slots 408 can be formed in top surface 504 of first wall portion 500 or in straight section 902 of second plate 704. Beverage identification tile 1000 is inserted through a slot of the plurality of slots 408 and rests against protrusion 717 of first wall portion 500 within gap 1104. Thus, beverage identification tile 1000 is sized and shaped to fit within the aperture defined by each slot of the plurality of slots 408 and within gap 1104.

Figure 12C:
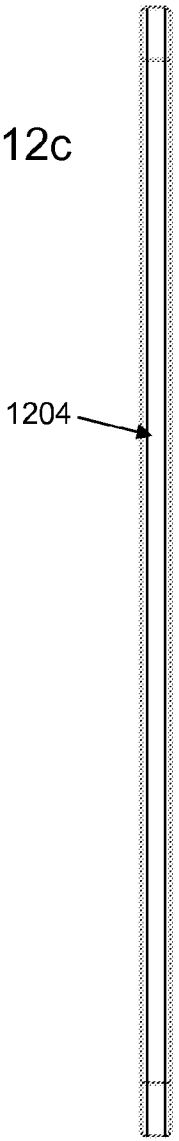
FIG. 12*c* depicts a side view of the beverage identification tile of FIG. 12*a* in accordance with an illustrative embodiment.
Figure 12B:
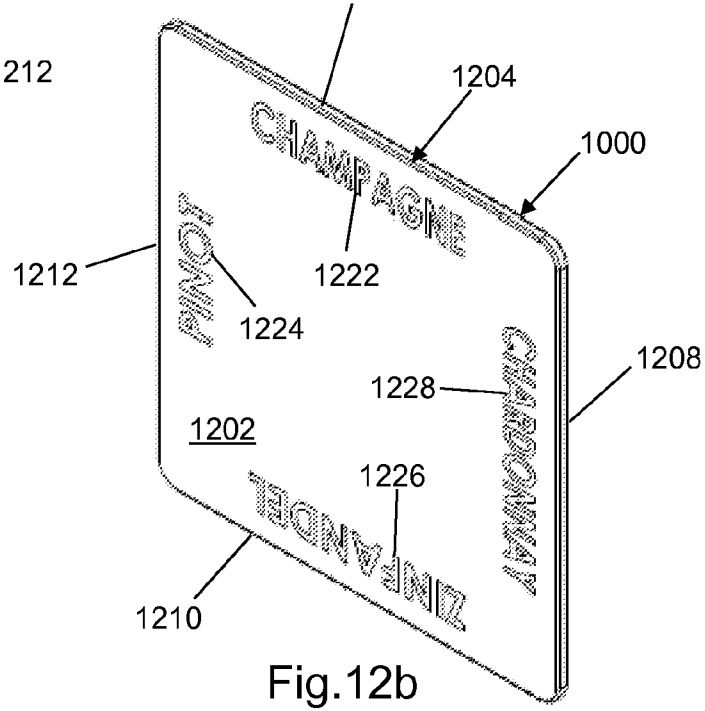
FIG. 12*b* depicts a back perspective view of the beverage identification tile of FIG. 12*a* in accordance with an illustrative embodiment.
Figure 12A:
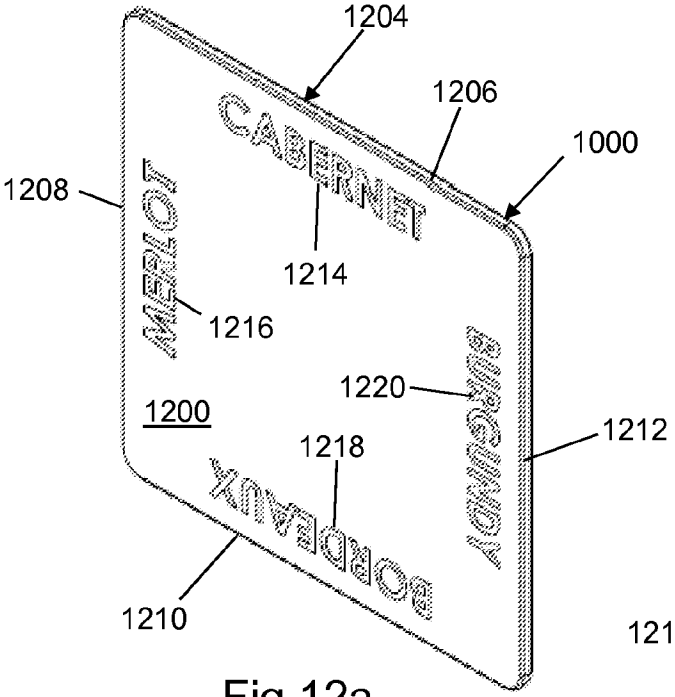
FIG. 12*a* depicts a front perspective view of a beverage identification tile of the shelf of FIG. 3 in accordance with an illustrative embodiment.
Figure 12E:
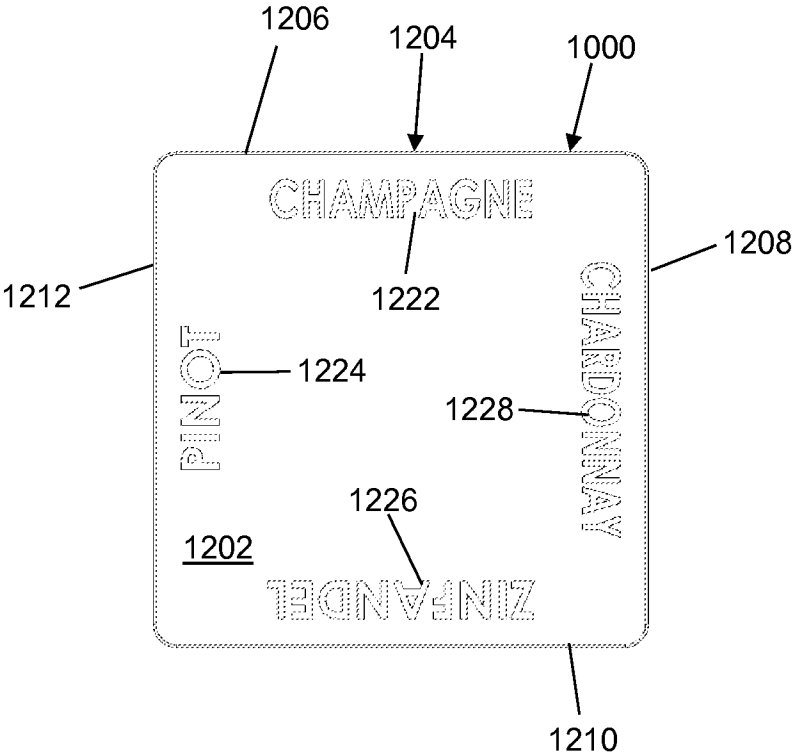
FIG. 12*e* depicts a back side view of the beverage identification tile of FIG. 12*a* in accordance with an illustrative embodiment.
Figure 12D:
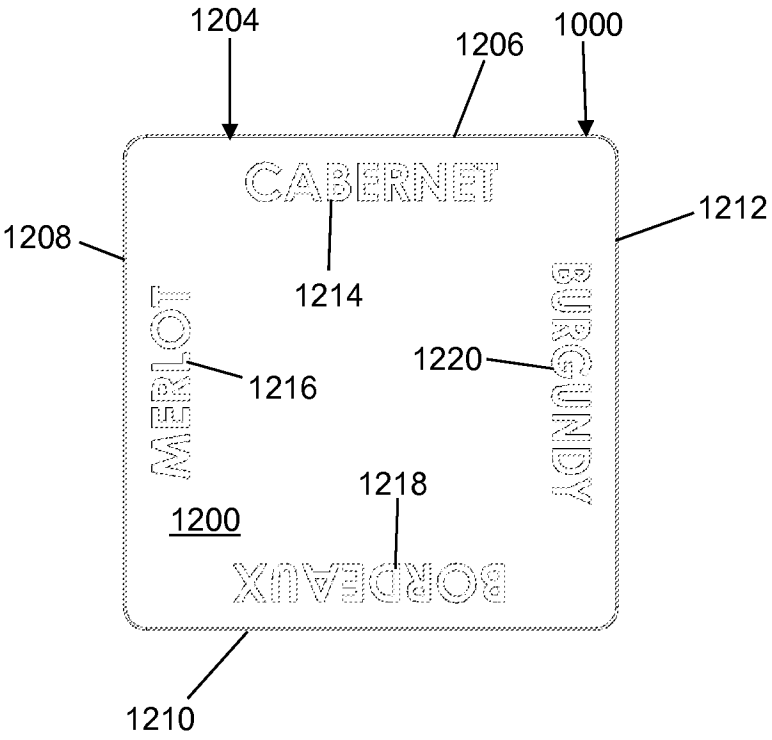
FIG. 12*d* depicts a front side view of the beverage identification tile of FIG. 12*a* in accordance with an illustrative embodiment.

With reference to FIG. 12*a*, a front perspective view of beverage identification tile 1000 is shown in accordance with an illustrative embodiment. With reference to FIG. 12*b*, a back perspective view of beverage identification tile 1000 is shown in accordance with an illustrative embodiment. With reference to FIG. 12*c*, a side view of beverage identification tile 1000 is shown in accordance with an illustrative embodiment. With reference to FIG. 12*d*, a front view of beverage identification tile 1000 is shown in accordance with an illustrative embodiment. With reference to FIG. 12*e*, a back view of beverage identification tile 1000 is shown in accordance with an illustrative embodiment. In the illustrative embodiment, beverage identification tile 1000 includes a sheet of material having a first face 1200 and a second face 1202 that is opposite the first face. For illustration, the material may be plastic, metal, etc.

First face 1200 and second face 1202 have a polygonal shape defined by a circumferential edge 1204 made up of a plurality of edges. For example, in the illustrative embodiment, first face 1200 and second face 1202 form a square with rounded corners and include a first edge 1206, a second edge 1208, a third edge 1210, and a fourth edge 1212. Second edge 1208 extends generally between first edge 1206 and third edge 1210, and fourth edge 1212 extends between first edge 1206 and third edge 1210 to form the square shape. A first plurality of beverage type identifiers are printed on first face 1200 along the edges 1206, 1208, 1210, 1212 of first face 1200. A second plurality of beverage type identifiers are printed on second face 1202 along the edges 1206, 1208, 1210, 1212 of second face 1202.

For illustration, the first plurality of beverage type identifiers include a first beverage type identifier 1214, "Cabernet", a second beverage type identifier 1216, "Merlot", a third beverage type identifier 1218, "Bordeaux", a fourth beverage type identifier 1220, "Burgundy", and the second plurality of beverage type identifiers include a fifth beverage type identifier 1222, "Champagne", a sixth beverage type identifier 1224, "Pinot", a seventh beverage type identifier 1226, "Zinfandel", an eighth beverage type identifier 1228, "Chardonnay". In the illustrative embodiment, the beverage type identifiers identify different types of wines. In alternative embodiments, the beverage type identifiers could identify different types of beer such as wheat, pilsner, stout, red ale, etc., identify different types of alcoholic beverages such as vodka, rum, whiskey, scotch, etc., identify different types of juices such as apple, cranberry, orange, etc. A different beverage type identifier is printed along each edge 1206, 1208, 1210, 1212 of first face 1200 and along each edge 1206, 1208, 1210, 1212 of second face 1202.

A portion 1106 of beverage identification tile 1000 extends above top surface 504 of first wall portion 500 when beverage identification tile 1000 is inserted in gap 1104 and rests against protrusion 717 of first wall portion 500. The beverage type identifiers are printed within a top portion 1106 of each edge 1206, 1208, 1210, 1212 so that the beverage type identifier is visible above top surface 504 of first wall portion 500, which forms an edge of front wall 320.

The beverage type identifiers are printed along each edge such that the beverage type identifier is aligned with the respective edge and oriented to be readable when the respective edge is oriented upward. Thus, first edge 1206 is oriented upwards so first beverage type identifier 1214 is readable; whereas, third edge 1210 is oriented downwards, and though legible, is not oriented in the normal reading direction from left to right. Of course, in some languages, words are read from the right to the left. In such cases, the lettering is oriented to be readable based on the language used.

In alternative embodiments, a beverage type identifier may not be included along each edge of beverage identification tile 1000. The beverage type identifier may be printed by etching into first face 1200 and/or second face 1202.

In the illustrative embodiment, beverage identification tile 1000 has a square shape. In alternative embodiments, beverage identification tile 1000 may have different shapes. For example, with reference to FIG. 13*a*, a front view of a beverage identification tile 1000*a* is shown in accordance with an illustrative embodiment. In the illustrative embodiment, beverage identification tile 1000*a* includes a sheet of material having a first face 1300 and a second face (not shown) that is opposite first face 1300. First face 1300 and the second face of beverage identification tile 1000*a* form a triangle. Beverage identification tile 1000*a* includes a first edge 1302, a second edge 1304, and a third edge 1306. A first plurality of beverage type identifiers are printed on first face 1300 along the edges 1302, 1304, 1306 of first face 1300 as well as on the second face not shown. For illustration, the first plurality of beverage type identifiers include a first beverage type identifier 1308, "identifier 1", a second beverage type identifier 1310, "identifier 2", and a third beverage type identifier 1312, "identifier 3".

Figure 13B:
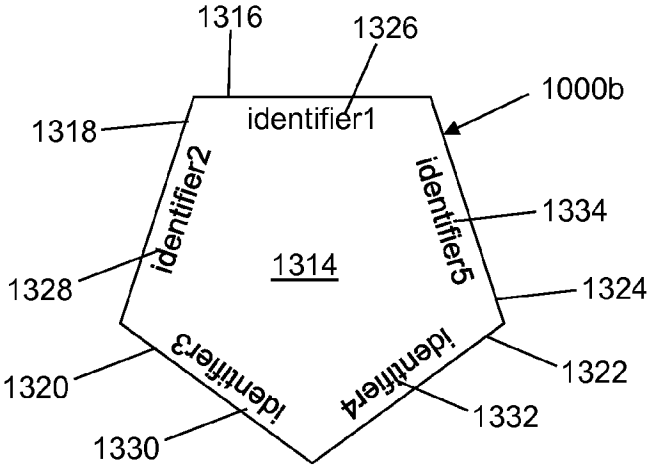
FIG. 13*b* depicts a front side view of a beverage identification tile of the shelf of FIG. 3 in accordance with a third illustrative embodiment.
Figure 13A:
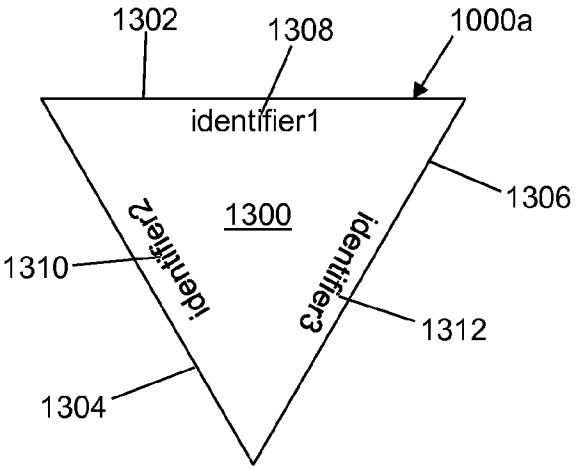
FIG. 13*a* depicts a front side view of a beverage identification tile of the shelf of FIG. 3 in accordance with a second illustrative embodiment.

With reference to FIG. 13*b*, a front view of a beverage identification tile 1000*b* is shown in accordance with an illustrative embodiment. In the illustrative embodiment, beverage identification tile 1000*b* includes a sheet of material having a first face 1314 and a second face (not shown) that is opposite first face 1314. First face 1314 and the second face of beverage identification tile 1000*b* form a pentagon. Beverage identification tile 1000*b* includes a first edge 1316, a second edge 1318, a third edge 1320, a fourth edge 1322, and a fifth edge 1324. A first plurality of beverage type identifiers are printed on first face 1314 along the edges 1316, 1318, 1320, 1322, 1324 of first face 1314 as well as on the second face not shown. For illustration, the first plurality of beverage type identifiers include a first beverage type identifier 1326, "identifier 1", a second beverage type identifier 1328, "identifier 2", a third beverage type identifier 1330, "identifier 3", a fourth beverage type identifier 1332, "identifier 4", and a fifth beverage type identifier 1334, "identifier 5".

Figure 13C:
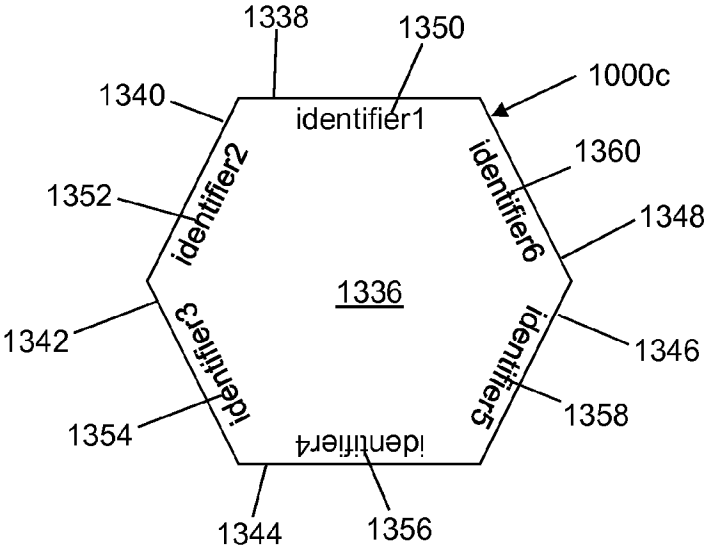
FIG. 13*c* depicts a front side view of a beverage identification tile of the shelf of FIG. 3 in accordance with a fourth illustrative embodiment.

With reference to FIG. 13*c*, a front view of a beverage identification tile 1000*c* is shown in accordance with an illustrative embodiment. In the illustrative embodiment, beverage identification tile 1000*c* includes a sheet of material having a first face 1336 and a second face (not shown) that is opposite first face 1336. First face 1336 and the second face of beverage identification tile 1000*c* form a hexagon. Beverage identification tile 1000*c* includes a first edge 1338, a second edge 1340, a third edge 1342, a fourth edge 1344, a fifth edge 1346, and a sixth edge 1348. A first plurality of beverage type identifiers are printed on first face 1336 along the edges 1338, 1340, 1342, 1344, 1346, 1348 of first face 1336 as well as on the second face not shown. For illustration, the first plurality of beverage type identifiers include a first beverage type identifier 1350, "identifier 1", a second beverage type identifier 1352, "identifier 2", a third beverage type identifier 1354, "identifier 3", a fourth beverage type identifier 1354, "identifier 4", a fifth beverage type identifier 1358, "identifier 5", and a sixth beverage type identifier 1360, "identifier 6".

In another illustrative embodiment, beverage identification tile 1000 may not be printed with beverage type identifiers. Instead, a paint marker may be used by a consumer to write beverage type identifiers of the consumer's choice on beverage identification tile 1000.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A shelf labeling system comprising:

a shelf comprising a base, a front wall, and a back wall, wherein the base is mounted between the front wall and the back wall, wherein the front wall comprises a first wall portion; and a second wall portion mounted to the first wall portion, wherein the second wall portion comprises a first plate, a second plate, and a third plate;

wherein the first plate extends from a first edge of the second plate, the third plate extends from a second edge of the second plate, wherein the first edge of the second plate is opposite the second edge of the second plate;

wherein the first plate forms an edge of the front wall, wherein a gap is formed between the second plate and the first wall portion when the second wall portion is mounted to the first wall portion;

a plurality of slots formed in the first plate of the second wall portion of the front wall; and a beverage identification tile comprising a sheet of material having a first face and a second face that is opposite the first face, wherein the first face and the second face have a polygonal shape defined by a plurality of edges; and a plurality of beverage type identifiers, with a different beverage type identifier printed along each edge of the plurality of edges of the first face and along each edge of the plurality of edges of the second face, wherein a single beverage type identifier of the plurality of beverage type identifiers is printed along each edge of the plurality of edges of the first face and along each edge of the plurality of edges of the second face, wherein each of the plurality of beverage type identifiers are printed along each edge such that the single beverage type identifier is aligned with the respective edge and oriented to be readable when the respective edge is oriented upward;

wherein the sheet of material is sized to slide into a slot of the plurality of slots with only one beverage type identifier of the plurality of beverage type identifiers visible above the edge of the front wall.

2. The shelf labeling system of claim 1, wherein the base comprises a plurality of rods mounted between the front wall and the back wall.

3. The shelf labeling system of claim 2, wherein the shelf further comprises a first side wall and a second side wall mounted between the front wall and the back wall, wherein a rod of the plurality of rods comprises:

a first rod portion;

a second rod portion; and a third rod portion, wherein the first rod portion and the third rod portion extend parallel to the first side wall and to the second side wall, and the second rod portion connects the first rod portion to the third rod portion and forms a curved section.

4. The shelf labeling system of claim 1, wherein the base extends upward from the front wall to the back wall relative to a horizontal plane defined between the front wall and the back wall.

5. The shelf labeling system of claim 1, wherein the first plate comprises a curved section.

6. The shelf labeling system of claim 5, wherein the plurality of slots are formed in the curved section.

7. The shelf labeling system of claim 5, wherein the first wall portion comprises a valley and the first plate mounts in the valley.

8. A device comprising:

a plurality of walls defining a receptacle;

a door;

a hinge pivotally mounting the door to a wall of the plurality of walls;

a shelf mounted between a pair of walls of the plurality of walls, the shelf comprising a base, a front wall, and a back wall, wherein the base is mounted between the front wall and the back wall, and further wherein the front wall is positioned to face the door, wherein the front wall comprises:

a first wall portion; and a second wall portion mounted to the first wall portion, wherein the second wall portion comprises a first plate, a second plate, and a third plate;

wherein the first plate extends from a first edge of the second plate, the third plate extends from a second edge of the second plate, wherein the first edge of the second plate is opposite the second edge of the second plate;

wherein the first plate forms an edge of the front wall, wherein a gap is formed between the second plate and the first wall portion when the second wall portion is mounted to the first wall portion;

a plurality of slots formed in the first plate of the second wall portion of the front wall; and a beverage identification tile comprising a sheet of material having a first face and a second face that is opposite the first face, wherein the first face and the second face have a polygonal shape defined by a plurality of edges; and a plurality of beverage type identifiers, with a different beverage type identifier printed along each edge of the plurality of edges of the first face and along each edge of the plurality of edges of the second face, wherein a single beverage type identifier of the plurality of beverage type identifiers is printed along each edge of the plurality of edges of the first face and along each edge of the plurality of edges of the second face, wherein each of the plurality of beverage type identifiers are printed along each edge such that the single beverage type identifier is aligned with the respective edge and oriented to be readable when the respective edge is oriented upward;

wherein the sheet of material is sized to slide into a slot of the plurality of slots with only one beverage type identifier of the plurality of beverage type identifiers visible above the edge of the front wall.

9. The device of claim 8, further comprising a heat exchange system configured to cool the receptacle.

10. The device of claim 8, further comprising:

a first sliding bracket mounted to a first wall of the pair of walls;

a second sliding bracket mounted to a second wall of the pair of walls;

a third sliding bracket, wherein the third sliding bracket is configured to mount to the first sliding bracket to allow sliding along the first sliding bracket; and a fourth sliding bracket, wherein the fourth sliding bracket is configured to mount to the second sliding bracket to allow sliding along the second sliding bracket;

wherein the shelf further comprises a first side wall and a second side wall mounted between the front wall and the back wall;

wherein the third sliding bracket is mounted to the first side wall and the fourth sliding bracket is mounted to the second side wall.

11. The device of claim 8, wherein the door includes a glass portion through which the beverage identification tile is visible.

12. The device of claim 8, wherein the first plate comprises a curved section and the plurality of slots are formed in the curved section.

* * * * *